United States Patent [19]

Mahoon et al.

[11] 4,394,224

[45] Jul. 19, 1983

[54] TREATMENT OF TITANIUM PRIOR TO BONDING

[75] Inventors: Alauddin Mahoon; Richard P. J. Kohler, both of Weybridge, England

[73] Assignee: British Aerospace Public Limited Company, London, England

[21] Appl. No.: 256,251

[22] Filed: Apr. 21, 1981

[30] Foreign Application Priority Data

Apr. 24, 1980 [GB] United Kingdom ..... 8013459

[51] Int. Cl.[3] ..... C25D 11/34

[52] U.S. Cl. ..... 204/57; 148/6.14 R

[58] Field of Search ..... 204/56 R, 57; 148/6.14 R

[56] References Cited

U.S. PATENT DOCUMENTS

| | | | |
|---|---|---|---|
| 2,934,480 | 4/1960 | Slomin | 204/56 R |
| 2,949,411 | 8/1960 | Beck | 204/56 R |
| 3,894,919 | 7/1975 | Schwartz et al. | 204/56 R |
| 3,956,082 | 5/1976 | Yoshimura et al. | 204/58 |

OTHER PUBLICATIONS

Industrial & Engineering Chemistry, vol. 47, pp. 2548–2554, 7/55.

10th National Sampe Technical Conference, vol. 10, 10/78 (Mahoon).

*Primary Examiner*—Sam Silverberg

*Attorney, Agent, or Firm*—Cushman, Darby & Cushman

[57] ABSTRACT

A method of treating articles of titanium or titanium alloy to form an adhesive receptive oxide layer includes the steps of applying to the surface to be treated a mixture of aqueous solutions of sodium hydroxide and hydrogen peroxide, maintaining the applied mixture within a temperature range in which the hydrogen peroxide is relatively stable and causing an increased rate of oxidation at the surface regions.

The increased rate of oxidation may be attained either by the addition of a catalyst to the mixture, or by impressing a voltage upon the mixture.

6 Claims, No Drawings

TREATMENT OF TITANIUM PRIOR TO BONDING

This invention relates to the formation of oxide on the surface of titanium and titanium alloys prior to adhesive bonding, to provide an adhesive receptive layer which ensures that the durability of a subsequently achieved adhesive bond is of a high order in both dry and humid conditions.

The formation of oxide on titanium surfaces can be alternatively effected by treatment in acid or alkaline mixtures. It is found that certain disadvantages are associated with the use of acid treatments; these include the toxicity of the mixture which causes waste disposal problems; the titanium is rendered susceptible to hydrogen embrittlement, and, the durability of the subsequent bond in humid and high ambient temperature conditions, is suspect.

These disadvantages are, in general, overcome by using an alkaline treatment, for example, immersion in a mixture of sodium hydroxide and hydrogen peroxide. However, it is found that to render the formation of the oxide layer sufficiently fast for use in other than laboratory conditions, the mixture must be at a temperature of about 65° C. At this temperature, hydrogen peroxide is unstable and, accordingly, this known treatment is unsuitable for continuous operation.

An objective of the present invention is to provide oxide layer forming treatments using sodium hydroxide and hydrogen peroxide mixtures which can be carried out at temperatures at which hydrogen peroxide is relatively stable. The treatments are thus suitable for more continuous operation.

According to this invention, there is provided a method of treating articles of titanium or titanium alloy to form an adhesive receptive oxide layer upon a surface region thereof, which method includes applying to the surface to be treated a mixture of aqueous solutions of sodium hydroxide and hydrogen peroxide, maintaining the applied mixture within a temperature range in which the hydrogen peroxide is relatively stable, and causing an increased rate of oxidation at the surface regions.

The concentration of the sodium hydroxide and the hydrogen peroxide solutions is chosen such that during treatment the surface is initially etched to remove an existing oxide layer, and then relatively rapidly oxidised to provide the adhesive receptive layer. It is thought that etching continues during oxidation at least in some conditions.

The mixture may conveniently be applied to the surface region to be treated by immersion of the surface region in the mixture, or in the form of a paste made by adding the mixture to an insoluble powder material, or by applying to the surface region to be treated a cloth material impregnated with the mixture.

To effect an increased rate of oxidation, in one example the mixture includes a catalyst selected from the transition elements contained in the fourth or fifth periods of the periodic table. The catalyst preferably includes manganese, iron or cerium.

In a further example, a voltage is impressed upon the mixture to provide an anodic treatment, thereby to increase the rate of oxidation at the surface region.

The mixture preferably contains sodium hydroxide in a solution concentration in the range of from 0.5 to 5 molar. The mixture also preferably contains hydrogen peroxide in a solution concentration in the range of from 0.1 to 1 molar.

When a catalyst is used to effect an increased rate of oxidation, the mixture preferably contains the catalyst in a solution concentration in the range of from 10 to 55 μgm/ml.

When an anodic treatment is used the voltage impressed preferably lies in the range of from 3 to 15 v.

In both the examples the mixture is preferably maintained at a temperature of approximately 25°±3° C. and the surface region is preferably applied with the mixture for a period of from 20 minutes to 75 minutes.

When a catalyst is used in the mixture, the mixture, together with the article to be treated, may be contained in a rotating barrel, thereby to effect agitation of the mixture.

In practice, for the catalytic treatment, specimens of commercial purity titanium (corresponding to BSTA6) and specimens of titanium alloy (6% Al-4% V-Ti to BSTA10) were wiped clean with methyl-ethyl-ketone, degreased in an alkaline cleaner (for example Oakite 61-B) for 15 minutes, rinsed in running hot tap water for 10 minutes and were subsequently immersed in mixtures having selected constituent concentrations. These were:

| | |
|---|---|
| 1 molar NaOH | 0.2 molar $H_2O_2$ |
| 1 molar NaOH | 0.5 molar $H_2O_2$ |
| 2 molar NaOH | 0.2 molar $H_2O_2$ |
| 2 molar NaOH | 0.5 molar $H_2O_2$ |
| 5 molar NaOH | 0.1 molar $H_2O_2$ |

Furthermore, each mixture included an additive in the form of $Mn^{2+}$, $Fe^{2+}$, or $Ce^{3+}$.

The catalysts were added by dissolving directly in the mixture or, alternatively, by forming and introducing an aqueous solution into the mixture.

Irrespective of the constituent concentrations, the mixtures were contained in a non-metallic vessel and the temperature was maintained at 25±3° C. during the immersion period of 60 minutes. Subsequently, the treated articles were rinsed in running hot tap water for 20 minutes followed by oven drying at 70° C. for 10 minutes. Bonding was effected within 48 hours of treatment, the adhesive being a modified epoxy resin produced by Ciba Giegy and referenced BSL 312-5. Bond durability was assessed by the modified fracture mechanics test exposing specimens at 49±2° C. in 95%-100% relative humidity for 5 hours. Durability was found to be good in all cases.

In the anodic treatment example, preferably the ranges of the constituent solution concentrations of the mixture are:

| | |
|---|---|
| NaOH | 0.5 to 5 molar |
| $H_2O_2$ | 0.1 to 1 molar |

In practice, for the anodic treatment, specimens of commercial purity titanium (corresponding to BSTA6) and specimens of titanium alloy (6% Al-4% V-Ti to BSTA10) were wiped clean with methyl-ethyl-ketone, degreased in an alkaline cleaner (Oakite 61-B) for 15 minutes, rinsed in running hot tap water for 10 minutes and were subsequently immersed in solutions having selected constituent concentrations. These were:

| | |
|---|---|
| 1 molar NaOH | 0.5 molar $H_2O_2$ |
| 1 molar NaOH | 1.0 molar $H_2O_2$ |
| 2 molar NaOH | 0.2 molar $H_2O_2$ |
| 2 molar NaOH | 0.5 molar $H_2O_2$ |
| 5 molar NaOH | 0.1 molar $H_2O_2$ |

Irrespective of the constituent concentrations, the solutions were contained in a stainless steel or a non-metallic container and the temperature maintained at 25±3° for the duration of the treatment. A DC voltage was then impressed by connecting the positive terminal of the supply to the article and the negative terminal to the stainless steel container. If a non-metallic container was used, then a counter electrode of stainless steel was connected to the negative supply terminal.

The voltage was maintained at 3–15 volts for a period of 20–45 minutes. Subsequently, the treated articles were rinsed in running hot tap water for 20 minutes followed by oven drying at 70° C. for 10 minutes. Bonding was effected within 48 hours of treatment, the adhesive being a modified epoxy resin produced by Ciba Giegy and referenced BSL 312-5. Bond durability was assessed by the modified fracture mechanics test exposing specimens at 49±2° C. in 95%–100% relative humidity for 5 hours. Durability was found to be good in all cases. In either of the above examples, the mixture of aqueous solutions of sodium hydroxide and hydrogen peroxide may be applied to the article to be treated by impregnating a cloth with the mixture and then applying the impregnated cloth to the surface region to be treated. Alternatively, the mixture may be formed into a paste by mixing it with an insoluble powder material and the paste may then be applied to the surface region to be treated. A form of insoluble powder material which has been found to be suitable in marketed under the name "Aerosil" by Ciba Giegy.

Where the mixture of aqueous solutions of sodium hydroxide and hydrogen peroxide are to be applied in conjunction with a catalyst and it is wished to treat a batch of articles, the mixture and catalyst may be contained in a barrel which is rotated to agitate the contents when the articles are being treated. This rotating barrel technique eliminates the need individually to wire or isolate each article of a batch and this may lead to production cost savings, particularly where batches of items are required to be treated at relatively infrequent intervals.

We claim:

1. A method of treating articles of Titanium or Titanium alloy to form an adhesive receptive oxide layer upon a surface region thereof, which method includes applying to the surface to be treated a mixture of aqueous solutions of sodium hydroxide in a solution concentration of from 0.5 to 5 molar and Hydrogen Peroxide in a solution concentration of from 0.1 to 1 molar, maintaining the applied mixture within a temperature range within which the Hydrogen Peroxide is relatively stable, and impressing a voltage of from 3 to 15 V on the mixture to provide an anodic treatment thereby producing an environmentally stable adhesive bonding surface.

2. A method according to claim 1, wherein said mixture is applied to the surface region to be treated by immersion of the surface region in the mixture.

3. A method according to claim 1, wherein said mixture is applied to the surface region to be treated in the form of a paste made by adding the mixture to an insoluble powder material.

4. A method according to claim 1, wherein said mixture is applied to the surface region to be treated a cloth material impregnated with said mixture.

5. A method according to claim 1, wherein said mixture is maintained at a temperature of approximately 25°±3° C.

6. A method according to claim 1, wherein the surface region is applied with the mixture for a period of from 20 minutes to 75 minutes.

* * * * *